US005263653A

United States Patent [19]

Pallmann

[11] Patent Number: 5,263,653

[45] Date of Patent: Nov. 23, 1993

[54] TWIN-FLOW BEATER MILL FOR PREPARING FIBROUS MATERIALS

[75] Inventor: Wilhelm Pallmann, Zweibrücken, Fed. Rep. of Germany

[73] Assignee: Pallmann Maschinenfabrik GmbH & Co. KG, Zweibruecken, Fed. Rep. of Germany

[21] Appl. No.: 822,133

[22] Filed: Jan. 17, 1992

[30] Foreign Application Priority Data

Jan. 18, 1991 [DE] Fed. Rep. of Germany ..... 4101352

[51] Int. Cl.[5] ..... B02C 13/10; B02C 23/08

[52] U.S. Cl. ..... 241/79.1; 241/188.1

[58] Field of Search ..... 241/79.1, 186.2, 186.3, 241/188.1, 191

[56] References Cited

U.S. PATENT DOCUMENTS 1,527,818 2/1925 O'Neill ..... 241/188.1 X
2,830,771 4/1958 Pallmann ..... 241/188.1 X
3,684,198 8/1972 Pallmann ..... 241/73
4,161,295 7/1979 Hennecke et al. ..... 241/188.1 X
4,240,590 12/1980 Lautenschlager et al. ... 241/188.1 X

*Primary Examiner*—Frank T. Yost
*Assistant Examiner*—Clark F. Dexter
*Attorney, Agent, or Firm*—Foley & Lardner

[57] ABSTRACT

The invention relates to a twin-flow beater mill for preparing fibrous materials to produce intermediate products capable of further processing. It consists of a rotor fitted with beater plates surrounded by a cylindrical grinding surface. The rotor includes rotor plates which carry the beater plates and which form a guide duct, shaped like an annular disk, which opens out peripherally onto the center of the grinding surface. The beater plates are interrupted on the inlet side in the opening-out region of the guide duct, and on the outlet side replaceable retaining rings can be set on the two end faces of the grinding surface so as to variably adjust the classifying effect.

11 Claims, 2 Drawing Sheets

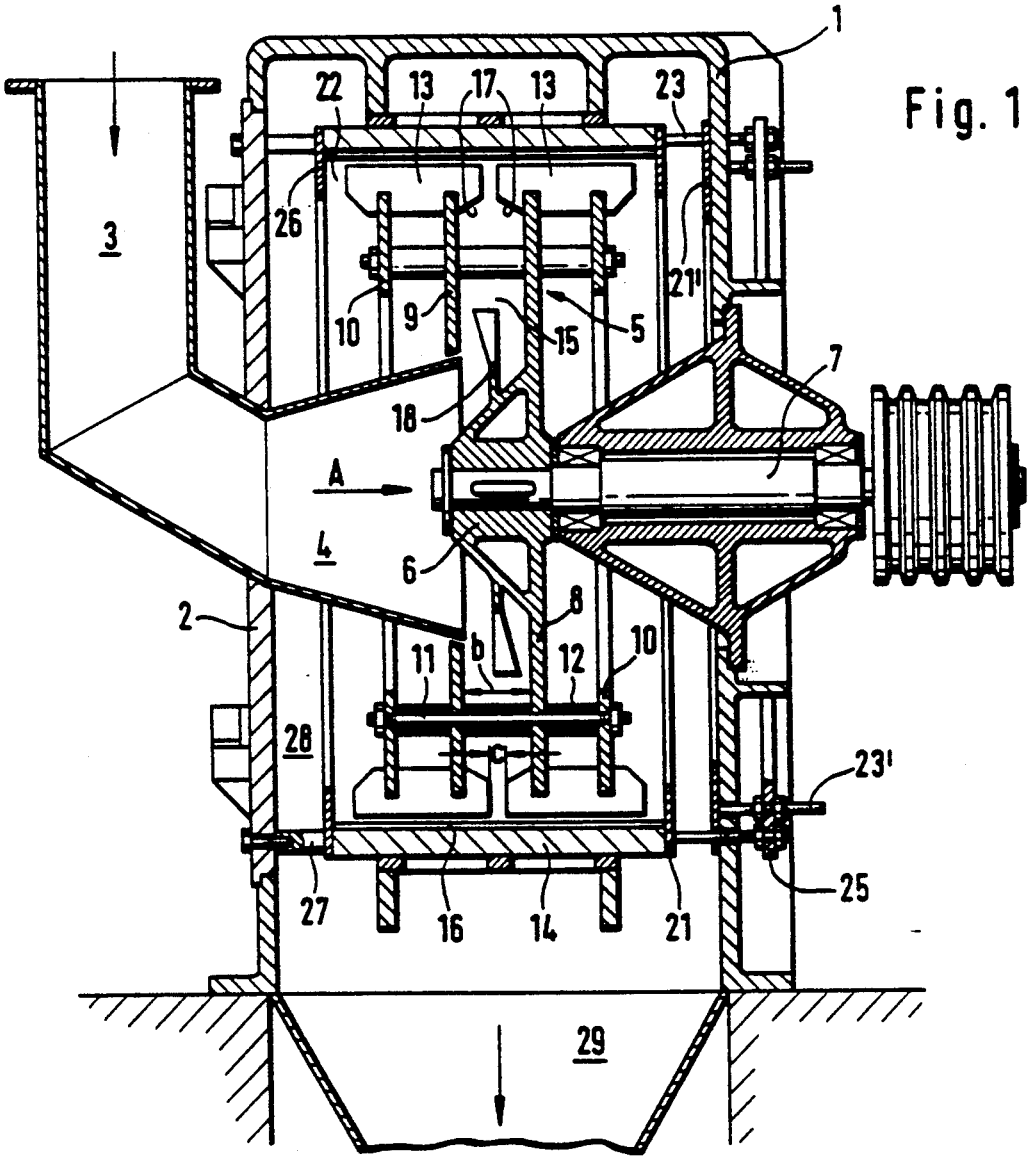
Fig. 1
Fig. 2
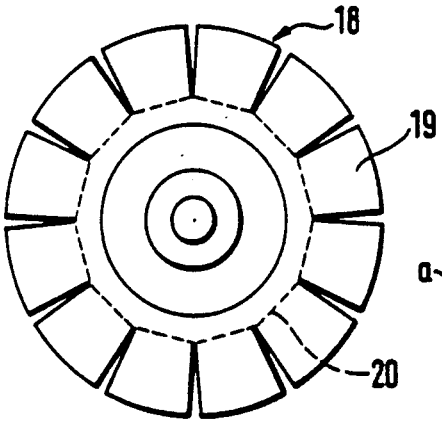
Fig. 3
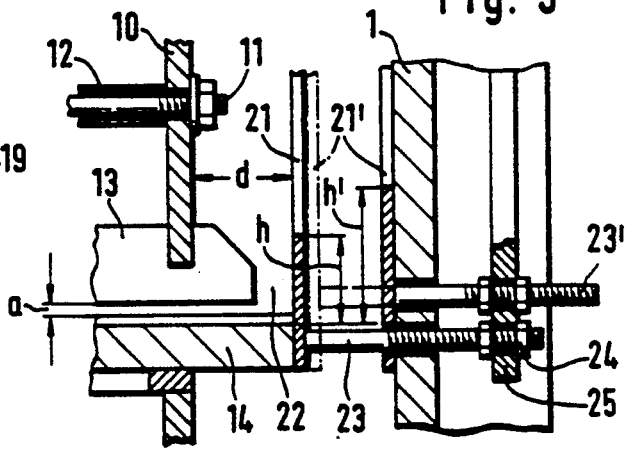

TWIN-FLOW BEATER MILL FOR PREPARING FIBROUS MATERIALS

BACKGROUND OF THE INVENTION

The invention relates to a twin-flow beater mill which enables fibrous materials to be prepared by disintegration parallel to the fibers into intermediate products such as are required for further industrial processing, for example, in the board or pulp industries.

Such fibrous materials occur as waste products, for example in the wood-processing and wood-working industries in the form of sawdust and planing shavings. However, large amounts of fibrous materials are also produced in the processing of annual plants, such as, for example, in the sugar-cane industry with regard to the so-called bagasse. Large amounts of fibrous waste materials are also to be prepared using grinding technology in the reuse of old paper.

Economic considerations dictate that the preparation of these fibrous materials to produce intermediate products capable of further processing be performed at high rates of throughput and with a low specific energy requirement. These operational conditions are fulfilled in principle by the so-called twin-flow beater mill in which the charging is performed in the axial center of a cylindrical grinding surface, from where the flow of material passes outwards through the annular grinding gap formed between the active edges of the beater plates and the grinding surface on two symmetrically axially opposed helical surfaces, aided by the air flow caused by the beater rotor. This mode of operation yields a high rate of throughput in conjunction with optimum utilization of the entire grinding surface area. In addition, it is possible by the purposeful selection of design parameters, such as grinding surface configuration, grinding gap width, number of beater plates and the like, or else by the selection of suitable operational parameters, such as speed of the beater rotor or influencing of the air flow, to conduct the grinding process in such a way that the ground material is subjected only to as much energy as is just sufficient for the targeted degree of comminution of the respective material.

Such a twin-flow beater mill has been disclosed in German Patent 1,909,022. It has a beater rotor, which is fitted with beater plates and surrounded concentrically by a cylindrical grinding surface, and whose rotor disks which carry the beater plates in the axial rotor center form an axially charged guide duct shaped like an annular disk which opens out peripherally onto the grinding surface. Correspondingly cylindrical screen webs which determine the targeted degree of fineness of the ground material are arranged on both sides of the grinding surface.

Although this type of mill has proved outstanding in the comminution of numerous types of material, substantial problems occur, especially with a damp charge, in processing fibrous materials which contain fractions that are overlong and, additionally, thin, that is to say in the form of strands or strings. This enables the use of this type of mill in the special industrial field of the preparation of fibrous materials only with additional complicated measures, if at all.

Thus, in the known twin-flow beater mill, the rear edges of the beater plates, which bridge the guide duct, which is shaped like an annular disk in its peripheral opening-out region, act as a trap for the fibrous fractions in the form of strands. As a result, it is possible, especially with a damp charge, for them to build up on the inside of the beater plates irregular accumulations of material which cause eccentric unbalanced masses, so-called unbalance, on the beater rotor, the consequence of which is uneven running of the machine. Moreover, in this way the beater rotor clogs up gradually and over its circumference in an irregular distribution, resulting in a pulsating flow of material in conjunction with a decreasing rate of throughput. The known twin-flow beater mill has therefore had to be frequently shutdown for the purpose of scraping the beater rotor. However, even the installation of special scrapers has not been able to provide a satisfactory remedy here, despite a substantial outlay on design.

In addition, with the known twin-flow beater mill it is not possible for the degree of disintegration of the fibrous materials to be quickly adapted by simple measures to changed operating conditions such as can be caused in the event of a change in state of the charge or as a consequence of changed requirements for further processing. Because of the risk of blockage, it is not possible to use the replaceable screen rings that are arranged on both sides of the grinding surface and which have proved themselves for determining the degree of fineness in the case of granular ground material for fibrous materials. As a result, it was necessary for the retention time of the material on the grinding surface, and thus its degree of disintegration, to be influenced only by exchanging the grinding surface for one having a different angular orientation of the grinding surface ribs. Not only was this removal expensive and the conversion time consuming, but it also required the service personnel to have a high degree of practical knowledge.

SUMMARY OF THE INVENTION

It is therefore the object of the invention to render the operating principle of the twin-flow beater mill capable of use for the preparation of fibrous materials in a manner protecting the fibers, and to be precise both with regard to trouble-free feeding of material and with respect to discharging material without difficulty in a simple way capable of influencing the degree of disintegration.

The object is achieved by interruption of the beater tools in the peripheral opening-out region of the annular disk-shaped guide duct which creates an entirely free passage of material to the grinding surface, and which ensures that it is no longer possible for accumulations of material to build up there. In addition, the retaining rings bearing on both sides against the end faces of the grinding surface form annular classifying chambers which are free of internals and also guarantee a discharge of material that is trouble-free and yet capable of being influenced in a simple way with regard to the degree of disintegration.

A further feature of the invention is the designed configuration of the beater rotor so that it is possible according to the invention for the beater tools to be interrupted in structural terms in the opening-out region of the guide duct shaped like an annular disk.

Since the width of the interruption of the beater tools consisting of beater plates is only a fraction of the width of the guide duct shaped like an annular disk, the beater plates lose only a small part of their active edges owing to the interruption, it being the case, moreover, that the chamfers provided at the rear on the beater plates ensure that no deposition of material can form here.

Proven to be particularly advantageous is a configuration of the beater rotor in which the two axial rotor halves are offset with respect to each other in the circumferential direction by half the spacing of the beater plates, the beater plates extending with their inner side edges in each case at least as far as the axial center of the beater rotor and, if desired, past such axial center so that the edges of the plates overlap.

The invention further includes a distribution disk which projects into the disk-shaped guide duct shaped like an annular disk, with the pneumatically charged fractions receiving additional tangential motive impulses by means of which they are hurled in a pinpointed fashion into the region of the grinding surface.

This pinpointed relative centrifugal force can be further increased by subdividing the distribution disk into peripheral sectors that can optionally be bent out of the plane of the disk and twisted into one another.

If the grinding surface projects on both sides beyond the beater plates, the two classifying chambers formed by the retaining rings experience a corresponding axial widening.

The setting of the retaining rings by means of control elements that can be locked outside the machine housing also serves at the same time as an axial bearing for the grinding surface, which can be hydraulically pushed out of the housing in the axial direction for the purpose of replacing the grinding surface. Because of the additional retaining rings held in a position of readiness in the mill housing, the possibility exists of influencing the classifying effect, and thus the degree of disintegration, gradually during the operation.

Since, according to the invention, the retaining rings arranged on both end faces of the grinding surface effect the classification, and thus the influencing of the retention time of the material on the grinding surface, the grinding surface can now be occupied by axially directed, replaceable strips, ribs or the like. This not only reduces the costs of producing the grinding surface, but also greatly simplifies the improvement work on it.

BRIEF DESCRIPTION OF THE DRAWINGS

An exemplary embodiment of the invention is represented in the drawing, wherein:

FIG. 1 is an axial cross-sectional view of a twinflow beater mill configured according to the invention;

FIG. 2 is an end view looking in the direction of the arrow A of FIG. 1 and showing the configuration of the beater rotor in more detail;

FIG. 3 is an enlarged, fragmentary view showing the grinding surface and adjacent elements in more detail;

DETAILED DESCRIPTION OF THE PREFERRED EMBODIMENTS

Figure 4:
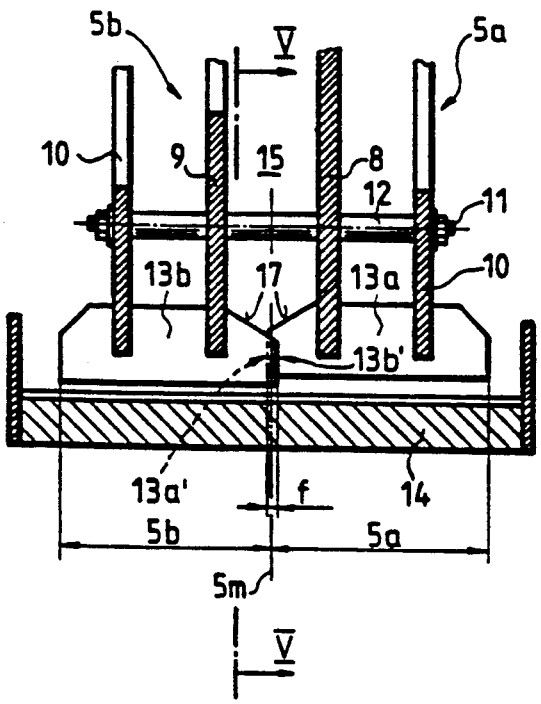
FIG. 4 is a particular refinement of the invention in axial partial section according to IV—IV in FIG. 5.

On its front end face, the mill housing 1 has a door 2 that can swivel out and through which an inlet duct or socket 3 extends. The duct 3 merges inside the housing 1 into an expanding distributor cone 4, with the material being preferably fed through the duct 3 and cone 4 in a pneumatic fashion.

Supported in a floating mount in the housing 1 on the rear housing wall is a beater rotor 5. It consists of a rotor hub 6 which is connected to rotate with the drive shaft 7 of a drive motor. Fixed to the rotor hub 6 is a rotor hub disk 8, which is connected to an inner annular disk 9 and two outer annular disks 10 by means of anchor bolts 11 and spacer bushings 12.

The hub plate 8 and the three annular disks 9 and 10 are fitted on their circumference with beater plates 13 whose outer edges cooperate with a stationary grinding surface 14 which surrounds the beater rotor 5 concentrically and defines therewith a grinding gap a (FIG. 3).

The hub disk 8 forms with the inner annular disk 9 a guide duct 15, shaped like an annular disk, which has an axial width b and into whose central region the distributor cone 4 opens. In its peripheral region, the guide duct 15 opens out onto the axial center of the grinding surface 14, which is occupied by strips or ribs 16 that are distributed uniformly over its circumference and extend in an axially parallel fashion.

The beater plates 13 are centrally interrupted to form a width c, which is at most 1/5 of the width of guide 15, in the peripheral opening-out region of the guide duct 15 and are provided at the rear edges thereof adjacent the width c with corresponding chamfers 17. Moreover, a distribution disk 18 which is fixed to the rotor hub 6 is arranged in the central region of the guide duct 15. As may be seen from FIG. 2, the distribution disk 18 is subdivided in its outer region into sectors 19 which can optionally be bent out of the plane of the disk about their chords 20 and can be twisted into one another.

Bearing against the two end faces of the stationary grinding surface 14 are retaining rings 21 and 26 which have a retaining rim height h and therefore form with the two outer regions of the grinding surface 14 and the two outer annular disks 10 of the beater rotor 5 two annular classifying chambers 22 which have an axial extent d (FIG. 3) and in which the beater plates 13, which project laterally beyond the outer annular disks 10, function in addition as classifier blades. The retaining ring 21 on the drive side is provided with a plurality of control elements 23, which are distributed on the circumference and guided through the wall of the housing 1, and which can be locked by means of jam nuts 24 on webs 25 provided outside the housing.

A second retaining ring 21' with a higher retaining rim h' is held in a position of readiness on the drive side on the inner wall of the housing 1, and is likewise locked by means of control elements 23' on the webs 25. Consequently, as indicated by dot and dash lines in FIG. 3, the second ring 21' can additionally be set on the first retaining ring 21 when a higher separation efficiency of the classification is required.

On the inlet side, the retaining ring 26 engaging the adjacent end face of the grinding surface 14 is held in place by holding bolts 27 which are replaceably screwed on the inside of the housing door 2. Since it is thus possible to directly exchange a retaining ring when the door 2 is opened, there is no need for an additional retaining ring to be held in a position of readiness on the inner wall thereof. However, this is also possible in principle, if it is desired to influence the classifying effect during operation.

Located on both sides of the two classifying chambers 22 are annular discharge chambers 28 which are spatially connected to the common material outlet 29.

Figure 5:
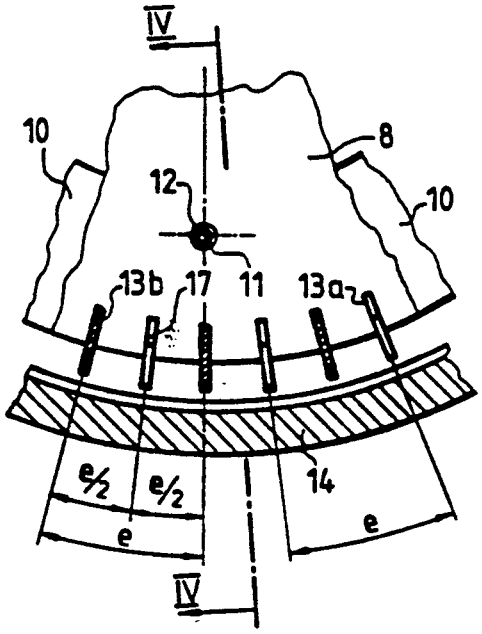
FIG. 5 is a radial partial section according to line V—V in FIG. 4.

FIGS. 4 and 5 show a further embodiment of the invention in which the two axial halves 5*a* and 5*b* of the beater rotor are offset with respect to each other in the axial direction by half the spacing e of the beater plates 13*a* and 13*b*. In this case, the beater plates 13*a* and 13*b* extend in the axial direction at least as far as the axial center 5*m* of the beater rotor 5. However, as shown in FIG. 4, they may also cover one another by a small amount f.

The twin-flow beater mill configured according to the invention operates as follows. With the aid of the ventilation effect caused by the beater rotor 5, the fibrous material is pneumatically fed through the inlet socket 3 to the beater mill, where it passes through the widening distributer cone 4 into the guide duct 15 in the shape of an annular disk. Here, it impinges on the distribution disk 18, from where it is hurled off tangentially with an additional mechanical impulse in the direction towards the axial center of the grinding surface 14. As a consequence of the interruption c of the beater plates 13 provided in the opening-out region of the guide duct 15, and the chamfered rear edges 17, the entire flow of material, that is to say the above-mentioned blockage-prone fractions in the form of strands, strings or threads, passes unhindered into the central region of the grinding surface 14. Starting from here, the flow of material then splits into two subflows which move pneumatically in opposite axial directions. In the process, the component of movement caused by the beater plates 13 is superimposed on the axial component of movement effected by the air flow, so that the two subflows move on oppositely directed helical surfaces through the annular grinding gap a bounded by the active edges of the beater plates 13 and the cylindrical grinding surface 14. In the process, they pass friction, shear and turbulent zones of high intensity which arise because the active edges of the beater plates 13 pass at high speed by the strips or ribs 16 of the grinding surface 14 at the grinding gap spacing a. The high-energy shear and friction forces prevailing here effect, in conjunction with the material particles passing the grinding gap a in a tightly packed fashion, predominantly autogenous comminution effects which comminute the material chiefly parallel to the fibers, so that very narrow, slim slivers or splinters are formed whose fiber structure remains, however, largely undamaged.

After the grinding gap has been passed, the retaining rings 21 and 26 bearing against the two end faces of the grinding surface 14 deny the fibrous splinters produced in this way free axial outlet. Rather, there is imparted to the two material flows arriving there paths of movement that are helix spiral in shape that tend radially inwards. As known from the theory of air classification, a state of equilibrium is set up on these spiral surfaces between the centrifugal forces acting on the material particles, on the one hand, and the drag forces, on the other hand. As a consequence of the diminuation of the particle size in the case of comminution, the centrifugal forces, depending on the particle volume, decrease in accordance with the laws of nature approximately in accordance with the third power of their magnitude, and thus more rapidly than the drag forces, which depend on the "shadow area" and decrease only approximately in accordance with the second power. The consequence of this is that as the degree of comminution progresses the drag forces acting from the air flow on the particles gradually exceed the centrifugal forces. Consequently, the splinter-shaped particles are held in the region of the grinding surface by these centrifugal forces acting on them only until they are reduced to a size at which the drag force exceeds the centrifugal force. Only then are they entrained by the spiral flow prevailing in the two classifying chambers 22 and discharged over the retaining rim of the retaining rings 21 and 26 into the two lateral discharge chambers 28, from where they then pass into the common material outlet 29.

If, as a consequence of replacement of the charge or in the event of changed requirements for further processing, a smaller particle size or a higher separation efficiency is required, the second retaining ring 21' with higher retaining rim h', which is held on the inside of the housing 1 in a position of readiness, can be additionally set on the first retaining ring 21 by means of its control element 23'.

What is claimed is:

1. A twin-flow beater mill for producing elongated fibrous material, which constitute intermediate products for further processing, comprising:

a housing, means within the housing for defining an annular grinding surface, an axial material inlet, a beater rotor mounted for rotation in said housing, said beater rotor including rotor disks which have beater plates mounted therein, the radially outer edges of said beater plates defining with said grinding surface a grinding gap, said grinding surface having end faces, said rotor disks being axially spaced and defining there between an annular disk-shaped guide duct the radial outer end of which opens out at its periphery onto said grinding surface, said beater plates extending axially substantially the entire width of said grinding surface except for an interruption in the region of said guide duct whereby material is directed radially outwardly through said guide duct directly onto said grinding surface and thereafter axially outwardly through said grinding gap for contact and comminution by said beater plates, and at least one retaining ring mounted on each of the end faces of said grinding surface, said at least one retaining ring having a retaining rim height which controls the retention time of said material in the grinding gap and thus the classifying effect on said material.

2. The beater mill as claimed in claim 1, wherein said beater rotor consists of a hub disk rigidly connected to a rotor hub, an inner annular disk and two outer annular disks which are connected to one another by means of anchor bolts and spacer bushings, said hub disk and the inner annular disk forming said annular guide duct.

3. The beater mill as claimed in claim 1, wherein the beater rotor has an axial center and comprises two axial halves which are mutually offset in the circumferential direction by half a division of the beater plates, the beater plates extending in the axial direction at least as far as the axial center of the beater rotor.

4. The beater mill as claimed in claim 2, wherein the width of the interruption of the beater plates is at most 1/5 of the width of said guide duct, and wherein said beater plates have rear edges provided with chamfers located axially inwardly of the rotor disks which form said guide duct.

5. The beater mill as claimed in claim 1, further including a distribution disk attached to a hub of the rotor and positioned in said guide duct.

6. The beater mill as claimed in claim 5, wherein said distribution disk is subdivided into peripheral sectors extending radially outwardly from chords, said sections being bent out of the plane of the disk about said chords.

7. The beater mill as claimed in claim 6 wherein said sections are twisted into one another.

8. The beater mill as claimed in claim 1, wherein said grinding surface projects axially beyond the beater plates on both sides.

9. The beater mill as claimed in claim 1, wherein said retaining rings are provided with control elements by means of which they can be adjusted in the axial direction and can be locked on webs provided outside the mill housing.

10. The beater mill as claimed in claim 9, wherein at least one additional retaining ring with a higher retaining rim is provided adjacent an end face of said grinding surface, said at least one additional retaining ring being held in a position of readiness on an inner wall of said housing, and further including additional control elements for adjustably setting the position of said at least one additional retaining ring.

11. The beater mill as claimed in claim 1, wherein said grinding surface is formed by axially parallel, replaceable strips or ribs.

* * * * *